United States Patent [19]

Krause et al.

[11] Patent Number: 4,744,453

[45] Date of Patent: May 17, 1988

[54] APPARATUS FOR TEMPORARY STORAGE OF CIGARETTES OR THE LIKE

[75] Inventors: Lothar Krause; Günter Menge, both of Hamburg, Fed. Rep. of Germany

[73] Assignee: Körber AG, Hamburg, Fed. Rep. of Germany

[21] Appl. No.: 899,347

[22] Filed: Aug. 22, 1986

[30] Foreign Application Priority Data

Aug. 22, 1985 [DE] Fed. Rep. of Germany ..... 3530028

[51] Int. Cl.[4] ..... B65G 47/44

[52] U.S. Cl. ..... 198/347; 198/524; 131/282; 414/292

[58] Field of Search ..... 198/347, 524, 530, 534; 131/282, 283, 907; 414/292

[56] References Cited

U.S. PATENT DOCUMENTS

| | | | |
|---|---|---|---|
| 2,997,828 | 8/1961 | Ahlbor | 198/347 |
| 3,561,585 | 2/1971 | McCombie | 198/347 X |
| 3,759,408 | 9/1973 | Rowlands et al. | 414/425 |
| 3,854,611 | 12/1974 | Wahle | 198/524 X |
| 3,921,790 | 11/1975 | Hinchcliffe et al. | 198/347 |
| 3,995,732 | 12/1976 | Figes et al. | 198/524 |
| 4,023,669 | 5/1977 | Clarke | 198/347 X |
| 4,368,742 | 1/1983 | Wahle et al. | 198/347 X |
| 4,555,011 | 11/1985 | Brown | 198/572 X |

*Primary Examiner*—Robert J. Spar
*Assistant Examiner*—Lyle K. Kimms
*Attorney, Agent, or Firm*—Peter K. Kontler

[57] ABSTRACT

Apparatus for temporary storage of cigarettes has a collecting vessel with a lateral inlet for a mass flow of parallel cigarettes and with a vertical duct at the bottom for evacuation of a mass flow of cigarettes. The top portion of the vessel carries two pivotable flaps whose lower portions are connected with spaced-apart portions of a flexible membrane in the form of a wire mesh which rests on the supply of cigarettes in the vessel. That flap which is adjacent the inlet of the vessel is heavier than the other flap and carries the mobile portion of a level monitoring device serving to regulate the rate of admission and/or evacuation of cigarettes and-/or to arrest the machine which makes the cigartettes.

14 Claims, 2 Drawing Sheets

APPARATUS FOR TEMPORARY STORAGE OF CIGARETTES OR THE LIKE

BACKGROUND OF THE INVENTION

The invention relates to improvements in apparatus for temporary storage of cigarettes of other rod-shaped articles of the tobacco processing industry. More particularly, the invention relates to improvements in apparatus for temporary storage of articles which are supplied by one or more article feeding conveyors are are evacuated by one or more article withdrawing conveyors. Still more particularly, the invention relates to improvements in apparatus wherein a collecting vessel can temporarily store articles when the rate of admission of articles exceeds the rate of withdrawal or evacuation, and which can satisfy the requirements of the evacuating means for a certain interval of time when the rate of evacuation exceeds the rate of admission.

Apparatus of the above outlined character are often used for temporary storage of filter rod sections or plain or filter cigarettes, cigarillos or cigars. Alternatively, such apparatus can be utilized to gather the output of two or more article feeding conveyors preparatory to evacuation of the accumulated articles from the collecting vessel for admission into a packing machine, into a filter tipping machine or into a magazine for longer-lasting storage.

If the collecting vessel is used for accumulation of rod-shaped articles which are about to be delivered to a tray filling apparatus, the conveyor or conveyors which admit the articles are normally designed to deliver articles along one or more horizontal paths. The tray filling apparatus can be disposed at a level below the collecting vessel so that the evacuating unit is designed to advance a mass flow of articles along a substantially vertical path. Alternatively, or in addition to the just described positioning of the evacuating means, the collecting vessel can be provided with a second outlet for evacuation of one or more layers of rod-shaped articles to a different destination, for example, to a packing machine.

It is further known to provide the collecting vessel with a so-called breathing cover which performs several functions. Thus, the cover can constitute a component of or it can carry an element of a level detector which monitors the accumulation of rod-shaped articles in the collecting vessel and serves to regulate the rate of admission of articles into and/or the rate of evacuation of articles from the collecting vessel. Furthermore, such level detector can be used to stop the article making machine when the collecting vessel is filled to capacity or when the article processing machine (such as the aforementioned tray filling apparatus or the aforementioned packing machine) is out of commission. In addition, the cover can serve as a means for preventing undesirable changes in the orientation of articles which are confined in the collecting vessel. As a rule, the articles are to be stored in the form of a stack of parallel articles.

U.S. Pat. No. 3,995,732 discloses an apparatus wherein the cover for the supply of rod-shaped articles in the collecting vessel comprises a membrane the ends of which are fixedly secured to the vessel. The apparatus further comprises a sensor in the form of a lever which rests on top of the membrane. It has been found that, when such apparatus receive rod-shaped articles at a high rate, the articles which enter the collecting space below the membrane accumulate into a pyramid and tension the central portion of the membrane so as to cause the lever to indicate that the vessel is filled at a time when the internal space of the vessel is capable of receiving a substantial quantity of additional articles. Thus, the nominal capacity of the vessel greatly exceeds the actual capacity.

U.S. Pat. Nos. 3,921,790 and 3,759,408 disclose modified apparatus wherein the cover comprises two pivotable levers one of which is mounted for pivotal movement in the upper region and the other of which is mounted for pivotal movement in the lower region of the space in the collecting vessel. The levers are sufficiently long to cross or overlap each other in the interior of the collecting vessel. A drawback of such apparatus is that the levers are likely to cause a misalignment of the admitted articles. Moreover, the levers are likely to cause the adjacent articles to jam so that the jammed and/or misaligned articles interfere with the mass flow of articles through the collecting vessel.

OBJECTS AND SUMMARY OF THE INVENTION

An object of the invention is to provide an apparatus for temporary storage of rod-shaped articles of the tobacco processing industry which is constructed and assembled in such a way that it allows for complete filling of the collecting vessel regardless of the rate at which the articles are admitted into and/or evacuated from the collecting vessel.

Another object of the invention is to provide the apparatus with a novel and improved cover which prevents or reduces the likelihood of misalignment of admitted articles and contributes to more uniform distribution of articles in the interior of the collecting vessel.

A further object of the invention is to provide the apparatus with novel and improved means for monitoring the quantity of articles which accumulate in the interior of the collecting vessel.

Still another object of the invention is to provide a novel and improved method of mounting a flexible membrane in the interior of the collecting vessel.

A further object of the invention is to provide an apparatus which can be installed in existing production lines for the making of rod-shaped articles of the tobacco processing industry.

An additional object of the invention is to provide a novel and improved collecting vessel for use in the above outlined apparatus.

A further object of the invention is to provide a novel and improved distribution of inlets and outlets in the collecting vessel of the above outlined apparatus.

The invention resides in the provision of an apparatus for temporary storage of rod-shaped articles of the tobacco processing industry. The apparatus comprises a collecting vessel which serves to store a supply of articles, means for admitting articles into the vessel, means for evacuating articles from the vessel, and a cover for the supply of articles in the vessel. The cover comprises two carriers which are movably mounted in the vessel and a flexible membrane in the form of a mat or the like which is connected to the carriers and serves to overlie the supply of articles in the vessel.

In accordance with a presently preferred embodiment, each of the two carriers includes a first portion which is movably (preferably pivotably) secured to the vessel and a second portion which is remote from the first portion. The membrane has spaced-apart first and second portions which are connected to the second portions of the carriers. The first portions of the carriers can be located at a level above the respective second portions, and the cover further comprises means for pivotally connecting the first portions of the carriers to the vessel. The evacuating means can be arranged to convey articles downwardly, and such evacuating means is preferably disposed at a level below the first portions of the carriers. The admitting means of such apparatus can include means for introducing articles into the vessel along a substantially horizontal path.

The apparatus can further comprise means for monitoring the height of the supply of articles in the vessel. Such monitoring means can include a portion which is mounted on or forms part of one of the carriers. The carriers of such apparatus are preferably arranged to rest on the supply of articles in the vessel and to exert a pressure upon the adjacent articles of the supply. The pressure which is exerted by the one carrier (which supports a portion of the monitoring means or which constitutes a portion of the monitoring means) preferably exceeds the pressure which is exerted by the other carrier. For example, the weight of the one carrier can exceed the weight of the other carrier. The one carrier is preferably adjacent the article admitting means.

The membrane can include a lightweight wire mesh or a mat. Furthermore, the membrane can include a substantially loop-shaped portion which is adjacent the admitting means.

As mentioned above, at least one of the carriers is preferably pivotable with reference to the collecting vessel about a fixed axis and includes a portion (the aforementioned second portion) which is remote from the pivot axis and is connected with the respective portion of the membrane. Such vessel can have a concave internal surface with a center of curvature on the pivot axis. The second portion of the one carrier is then movable along the concave surface when the level of the supply of articles in the collecting vessel rises or falls.

The apparatus can further comprise a magazine, and the evacuating means can include a duct (for example, a vertical duct) which connects the vessel with the magazine. At least one of the admitting and evacuating means can include means (for example a pair of cooperating endless belt conveyors or a duct) for conveying a mass flow of parallel rod-shaped articles, namely a flow consisting of two or more layers of articles travelling transversely of their respective axes.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
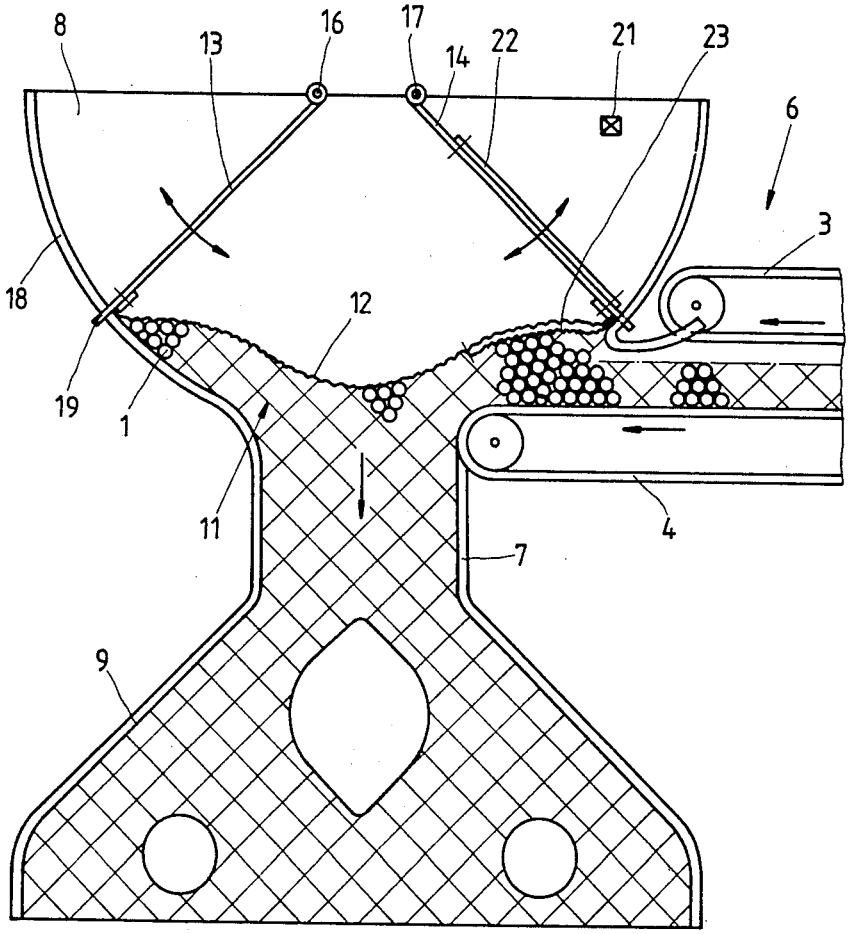
FIG. 1 is an elevational view of an apparatus which embodies one form of the invention, the carriers for the membrane being shown in first positions.
Figure 2:
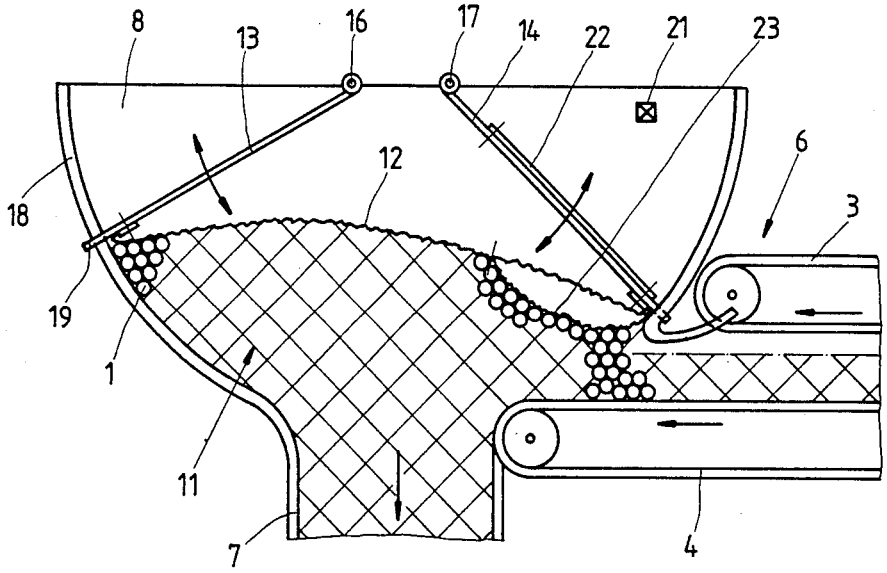
FIG. 2 shows the apparatus of FIG. 1 with the carriers in different positions in response to accumulation of articles in the interior of the vessel.
Figure 3:
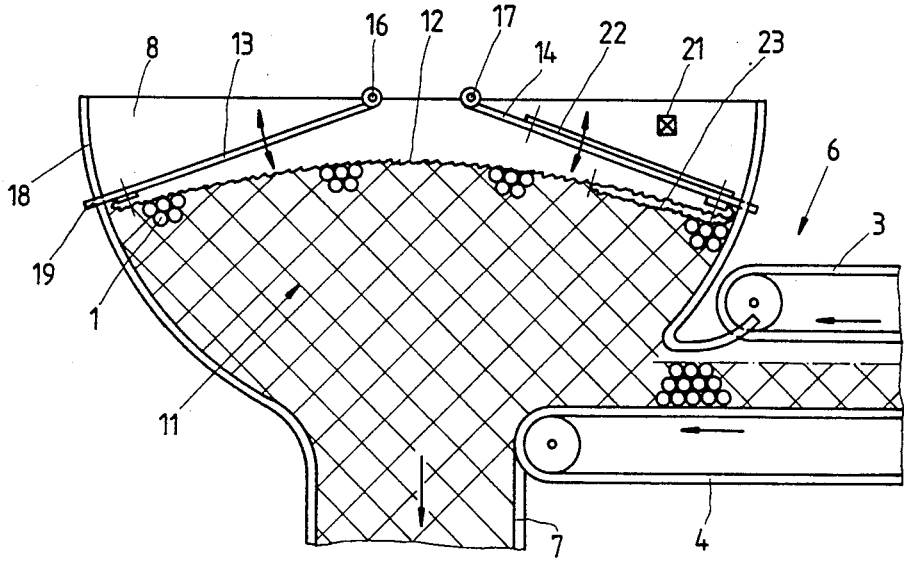
FIG. 3 shows the structure of FIG. 2 with the carriers in positions which they assume in response to accumulation of additional articles in the interior of the vessel.

The apparatus for temporary storage of rod-shaped articles 1 (for example, plain cigarettes) which is shown in FIGS. 1–3 comprises a collecting vessel 8 having an inlet which receives a mass flow of articles 1 along a horizontal path defined by an article admitting unit 6 including two endless belt conveyors 3 and 4. These conveyors can deliver the mass flow of articles 1 from the discharge end of a cigarette making machine. The outlet of the vessel 8 is located at a level below the inlet and serves for admission of a mass flow of articles 1 into an upright duct 7 constituting a means for evacuating articles from the vessel 8 and for admitting the articles into an intermediate magazine 9 which can be located upstream of or which can constitute the reservoir of a cigarette packing machine, not shown. Alternatively, the magazine 9 can form part of a tray- or charger-filling apparatus of conventional design. Trays can be used to transport groups of parallel rod-shaped articles to a remote packing machine or to another destination.

The collecting vessel 8 defines a variable-volume chamber 11 for a supply of parallel articles 1. The chamber 11 is large enough to temporarily store those articles which cannot be evacuated by way of the duct 7 when the output of the machine that supplies articles to the admitting means 6 exceeds the output of the machine or apparatus receiving articles from the magazine 9. The chamber 11 accommodates a cover which includes two pivotable carriers 13, 14 and a flexible membrane or mat 12 which can be made of fine wire mesh or the like. The illustrated carriers 13 and 14 constitute one-armed levers or flaps each having an upper portion pivotally connected to the collecting vessel 8 by a horizontal shaft 16, 17 and a second or lower portion which preferably rests on the topmost layer of articles 1 in the chamber 11 and is preferably separably connected with the respective end portion of the membrane 12. The shafts 16 and 17 are preferably located centrally of and at a level above the evacuating duct 7. The second or lower end portions of the carriers 13, 14 are provided with fingers or followers 19 which are adjacent one axial end of the collecting vessel 8 and are preferably configurated in such a way that they can travel along the outer side of the respective concavo-convex wall 18 of the vessel. The arrangement is preferably such that the second or lower end portions of the carriers 13, 14 are immediately adjacent or actually slide along the concave internal surfaces of the respective walls 18.

The apparatus further comprises a level monitoring device which serves to ascertain the height of the supply of articles 1 in the chamber 11 of the collecting vessel 8. In the illustrated embodiment, the monitoring device comprises a plate-like member 22 which is affixed to or forms part of the right-hand carrier 14 (i.e., that carrier which is nearer to the inlet of the vessel 8) and a transducer 21 which can generate a signal to stop the cigarette making machine when the member 22 assumes a horizontal or nearly horizontal position indicating that the chamber 11 has been filled to or sufficiently close to capacity. It is clear that the apparatus can employ a more complex monitoring device which generates signals denoting intermediate positions of the member 22 so as to regulate the speed at which the admitting means 6 delivers articles 1 into and/or the speed at which the articles are evacuated from the chamber 11.

The arrangement is preferably such that the weight of the carrier 14 and/or of the carrier 14 plus the plate-like member 22 exceeds the weight of the carrier 13. This contributes to a more reliable filling of the chamber 11 with rod-shaped articles 1. In other words, the pressure which the carrier 14 exerts upon the articles 1 therebelow preferably exceeds the pressure which the carrier 13 can exert upon the adjacent articles in the chamber 11.

The reference character 23 denotes a normally sagging looped portion of the membrane 12 which is adjacent to the second end portion of the carrier 14 at the inlet of the collecting vessel 8.

When the rate at which the endless belt conveyors 3 and 4 of the admitting means 6 supply a mass flow of articles 1 into the chamber 11 matches or approximates the rate of evacuation of articles by way of the duct 7, the membrane 12 assumes the position which coincides or approaches that shown in FIG. 1. The supply of articles 1 in the chamber 11 then includes two marginal portions, one adjacent the loop 23 and the other adjacent the lower or second end portion of the carrier 13, which are disposed at or close to the same level. This is desirable for uniform and predictable filling of the chamber 11 with articles as well as for proper guidance of the articles and for the prevention of misalignment of articles in the collecting vessel 8. Any misalignment could result in jamming of the duct 7 and long-lasting stoppage of the machine or machines which receive articles from the magazine 9. Proper alignment and guidance of articles are particularly important at the discharge end of the admitting means 6, i.e. at the inlet of the collecting vessel 8.

FIG. 2 shows the membrane 12 in an intermediate position in which the supply of articles 1 in the chamber 11 has risen above the level shown in FIG. 1. Such situation develops when the rate of admission of articles 1 by way of the path between the belt conveyors 3 and 4 of the admitting means 6 increases so that the rate of admission exceeds the rate of evacuation and the pile of articles in the chamber 11 rises. As can be seen in FIG. 2, the extent to which the lightweight carrier 13 is pivoted in a counterclockwise direction (when compared with the position shown in FIG. 1) exceeds the extent of counterclockwise pivoting of the heavier carrier 14 beyond the position of FIG. 1. The looped portion 23 along the right-hand margin of the membrane 12 sags into the chamber 11 and ensures highly desirable and accurate guidance of the topmost layer or layers of articles forming the mass flow which issues from the path between the conveyors 3 and 4.

As the rate of admission of articles continues to exceed the rate of evacuation, the carriers 13 and 14 continue to pivot in the clockwise and counterclockwise directions, respectively, toward and even beyond the positions which are shown in FIG. 3. The rising right-hand portion of the pile of articles 1 in the chamber 11 flattens the looped portion 23 and causes the carrier 14 to pivot so that the plate-like member 22 of the monitoring device approaches the transducer 21. When the collecting vessel 8 is filled to or close to capacity, the transducer 21 generates a signal which is used to arrest or to slow down the machine that supplies articles 1 to the admitting means 6. Such machine can constitute a cigarette maker of the type known as PROTOS. Pivoting of the lightweight carrier 13 to its uppermost position preferably precedes the pivoting of heavier carrier 14 to the upper end position; this contributes to more reliable and predictable filling of the entire chamber 11 before the machine which supplies articles to the admitting means 6 is arrested or is caused to deliver articles at a lower rate. The transducer 21 can also transmit signals to the motor for the conveyors 3 and 4 so that such conveyors are arrested as soon as the chamber 11 is filled to or close to capacity.

The illustrated flap—or lever—like carriers 13, 14 can be replaced with other types of carriers without departing from the spirit of the invention. The same applies for the material of the membrane 12. For example, each of the carriers 13, 14 can constitute or include a frame, a lattice, an arm or a suitable linkage. Furthermore, the carriers 13, 14 can be mounted for a more complex movement relative to the collecting vessel 8.

The weight of the carrier 14, which is adjacent to the inlet of the collecting vessel 8, need not necessarily exceed the weight of the carrier 13 which is remote from the admitting means 6. However, the utilization of a relatively heavy carrier 14 is desirable and advantageous on the aforedescribed grounds, i.e., this contributes to a more reliable and predictable guidance of articles which enter the collecting vessel 8 as well as to the ability of the vessel 8 to accumulate a larger supply of articles 1. The arrangement may be such that the weight of the carrier 14 without the plate-like member 22 of the monitoring means exceeds the weight of the carrier 13. The utilization of a relatively heavy carrier 14 for one end portion of the membrane 12 and for a portion of the monitoring device ensures that the timing of stoppage of the conveyors 3, 4 is more predictable.

The looped portion 23 is also optional. This portion exhibits the advantage that the membrane 12 can properly guide the incoming articles even when the admitting means 6 delivers the mass flow at a very high rate which can considerably exceed the rate of evacuation by way of the duct 7 and/or by way of another evacuating device.

The provision of walls 18 with concave internal surfaces which are closely adjacent to the respective end portions of the carriers 13 and 14 is desirable and advantageous because the carriers are less likely to squash and/or otherwise damage the adjacent articles.

It has been found that the improved cover is more likely to ensure complete filling of the chamber 11 with a large supply of parallel articles than the covers of conventional apparatus for temporary storage of cigarettes or the like. The aforediscussed mounting of the carriers 13 and 14 and the concavo-convex walls 18 reduce the likelihood of development of dead corners which are not filled with articles. This applies for each and every zone of the chamber 11, including those which are immediately adjacent to the walls 18. The improved apparatus ensures long-lasting disturbance-free operation regardless of whether the rate of admission of articles equals, exceeds or is less than the rate of evacuation.

The collecting vessel 8 can be provided with a second outlet, opposite the inlet, for evacuation of articles along a horizontal path directly to a packing machine. Such apparatus can be provided with suitable means for temporarily closing the one or the other outlet, depending upon whether the vessel 8 is to supply articles only to the intermediate magazine 9 or only to the packing machine.

One end of the vessel 8 can remain open or can be covered by a transparent or translucent wall (not shown) so as to allow for continuous observation of the accumulation of articles in the chamber 11.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for temporary storage of rod-shaped articles of the tobacco processing industry, comprising a collecting vessel arranged to store a supply of articles; means for conveying articles into said vessel; means for discharging articles from said vessel; and a cover for the supply of articles in said vessel, including two carriers movably mounted in said vessel and a flexible membrane connected to said carriers and arranged to overlie the supply of articles in the vessel, each of said carriers including a first portion movably secured to said vessel and a second portion remote from the first portion, said membrane having spaced-apart first and second portions connected to the second portions of said carriers.

2. The apparatus of claim 1, wherein the first portions of said carriers are located above the respective second portions and further comprising means for pivotally connecting the first portions of said carriers to said vessel.

3. The apparatus of claim 2, wherein said discharging means is arranged to convey articles downwardly and is disposed at a level below the first portions of said carriers.

4. The apparatus of claim 3, wherein said conveying means includes means for introducing articles into said vessel along a substantially horizontal path.

5. The apparatus of claim 1, further comprising means for monitoring the height of the supply of articles in said vessel, said monitoring means including a portion mounted on one of said carriers, said carriers being arranged to rest on the supply of articles in said vessel and to exert a pressure upon such supply, the pressure which is exerted by said one carrier exceeding the pressure which is exerted by the other of said carriers.

6. The apparatus of claim 5, wherein the weight of said one carrier exceeds the weight of said other carrier.

7. The apparatus of claim 5, wherein said one carrier is adjacent said conveying means.

8. The apparatus of claim 1, wherein said membrane includes a wire mesh.

9. The apparatus of claim 1, wherein said membrane includes a loop-shaped portion adjacent said conveying means.

10. The apparatus of claim 1, wherein at least one of said carriers is pivotable with reference to said vessel about a fixed axis, said vessel having a concave internal surface with a center of curvature on said axis, said second portion of said one carrier being movable along said concave surface.

11. The apparatus of claim 1, further comprising a magazine, said discharging means including a duct connecting said vessel with said magazine.

12. The apparatus of claim 1, wherein at least one of said conveying and discharging means includes means for conveying a mass flow of parallel rod-shaped articles.

13. Apparatus for temporary storage of rod-shaped articles of the tobacco processing industry, comprising a collecting vessel arranged to store a supply of articles; means for conveying articles into said vessel; means for discharging articles from said vessel; and a cover for the supply of articles in said vessel, including two carriers movably mounted in said vessel and a flexible membrane connected to said carriers and arranged to overlie the supply of articles in the vessel, one of said carriers being pivotable with reference to said vessel about a fixed axis and including a portion remote from said pivot axis and connected with said membrane, said vessel having a concave internal surface with a center of curvature on or close to said axis, said portion of said one carrier being movable along said concave surface.

14. The apparatus of claim 13, wherein each of said carriers includes a first portion movably secured to said vessel and a second portion remote from the first portion, said membrane having spaced-apart first and second portions connected to the second portions of said carriers.

* * * * *